United States Patent [19]

Walker

[11] Patent Number: 4,789,031

[45] Date of Patent: Dec. 6, 1988

[54] GAS ANCHOR AND TREATING DEVICE

[76] Inventor: Claud W. Walker, Rte. 1, Box 201, Portales, N. Mex. 88130

[21] Appl. No.: 52,997

[22] Filed: May 22, 1987

[51] Int. Cl.[4] ..... E21B 37/06

[52] U.S. Cl. ..... 166/369; 166/105; 166/902

[58] Field of Search ..... 166/105, 105.1, 304, 166/310, 371, 369, 370, 902; 204/197, 144, 150

[56] References Cited

U.S. PATENT DOCUMENTS

| | | | |
|---|---|---|---|
| 2,437,475 | 3/1948 | Oxford, Jr. | 166/902 |
| 3,420,183 | 1/1969 | Hart | 103/44 |
| 3,448,034 | 6/1969 | Craft et al. | 204/197 |
| 3,477,513 | 11/1969 | Ferguson | 166/304 |
| 3,486,999 | 12/1969 | Craft | 204/197 |
| 3,974,071 | 8/1976 | Dunn et al. | 210/57 |
| 4,278,549 | 7/1981 | Abrams et al. | 210/695 |

*Primary Examiner*—Jerome W. Massie
*Assistant Examiner*—Bruce M. Kisliuk
*Attorney, Agent, or Firm*—Marcus L. Bates

[57] ABSTRACT

A gas anchor is attached to the lower end of a downhole pump located downhole in a borehole so that fluid must flow from the lower borehole, into the gas anchor, to the suction of the pump, and to the surface of the ground. The gas anchor has a metal rod located within an outer housing. An annulus is formed between the housing interior and the outer surface of the rod. Both the housing and rod are made of a special alloy. The housing has a multiplicity of ports formed therein. Formation fluid located in the bottom of the borehole flows through the ports, into the housing, along the annulus between the housing and the rod, and into the pump intake. This action subjects the formation fluid to treatment prior to the fluid entering the pump suction. Accordingly, the fluid that must flow through the downhole pump, production tubing, and downstream flow lines are treated by the action of the special alloy from which the housing and central core are cast, thereby causing significant reduction in scale and corrosion of the metal surfaces that come in contact with the produced fluid.

2 Claims, 1 Drawing Sheet

GAS ANCHOR AND TREATING DEVICE

BACKGROUND OF THE INVENTION

Treatment of water and hydrocarbons downhole in a borehole is known to those skilled in the art. Some treatment often involves injecting expensive chemicals downhole in a borehole so that the chemicals are subsequently produced along with the production fluid. This is expensive and the residual chemical that is produced by the well must eventually be reckoned with somewhere downstream of the Christmas tree.

Several proposals for treating fluid downhole in a borehole without introducing chemicals have been considered as evidenced by U.S. Pat. No. 4,278,549 to Abrams et al; U.S. Pat. No. 3,448,034 to Craft et al; and U.S. Pat. No. 3,486,699, to Craft to which reference is made for further background of this invention.

These prior art references indicate that the physical characteristics of a flowing liquid is changed or modified by contact with a particular alloy. The explanation for the change in behavior of the flowing hydrocarbon is usually attributed to polarization of the molecules, or a change in electrostatic potential of the flowing hydrocarbon molecules. In the above U.S. Pat. No. 3,448,034 to Craft et al and Craft U.S. Pat No. 3,486,999, there is set forth a stabilizing element having a core contained within a housing. In U.S. Pat. No. 3,448,034, to Craft et al., the core is comprised of the following mixture:

| | Percent by weight |
|---|---|
| Copper | 57.64 |
| Zinc | 17.63 |
| Nickel | 13.45 |
| Lead | 7.66 |
| Tin | 2.69 |
| Iron | .69 |
| Antimony | .12 |
| Sulfur | .07 |
| Manganese | .05 |

The above mixture provides an alloy having a crystalline structure of non-conductive characteristics which is non-sacrificing in use. The core is arranged within a housing so that liquid flowing into and out of the housing is placed in contact with the surface of the core. The core has a polarizing effect on liquids flowing through the housing and prevents precipitation of minerals in solid form from being deposited on the tubing walls and other surfaces that come in contact with the flowing liquid downstream of the housing.

It would be desirable to have made available a formation fluid treatment that reduces the corrosive effect of the produced liquid so that the downhole pump, production tubing, and other downstream equipment associated with a wellbore is not subjected to the deleterious effects of the formation fluid. This is the subject of the present invention.

SUMMARY OF THE INVENTION

A gas anchor made in accordance with the present invention is attached to the suction end of a downhole pump so that formation fluid from a wellbore must flow through the gas anchor, into the pump intake, and up the tubing string to the surface of the ground.

The gas anchor treats formation fluid flowing therethrough because the entire gas anchor is made of a crystalline alloy that provides protection against the corrosive effects of the formation fluid. The gas anchor includes a perforated housing having attachment means at the upper end thereof by which the gas anchor is removably attached to the suction end of a downhole pump. The housing has a lower marginal end that is perforated and an upper marginal end that is imperforate. A core having an outside diameter smaller than the inside diameter of the housing is contained within the housing and mounted along the axial centerline of the housing. This forms an annular passageway between the core and the interior of the housing. The core has a lower marginal end received within the perforated lower marginal end of the housing, and an upper marginal end received within the imperforate upper marginal end of the housing so that the formation fluid must flow through the multiplicity of ports, along the annular passageway, where the formation fluid is placed in intimate contact with the surface area of the crystalline metal and subjected to treatment before it enters the pump suction. This treatment of the formation fluid eliminates scale, reduces corrosion, and prolongs the life of the pump, rod string, and production tubing.

Both the housing and the core of the gas anchor are made of an alloy as follows:

| | Percent by weight |
|---|---|
| Copper | 57.64 |
| Zinc | 17.63 |
| Nickel | 13.45 |
| Lead | 7.66 |
| Tin | 2.69 |
| Iron | .69 |
| Antimony | .12 |
| Sulfur | .07 |
| Manganese | .05 |

It is therefore a primary object of the present invention to provide a gas anchor made of a crystalline metal through which produced fluid must flow, and thereby change the properties of the fluid in a manner to reduce scale and corrosion of metal surfaces which contact the fluid.

A further object of the present invention is to provide an improved and economical means by which formation fluid can be treated downhole in a borehole before the fluid enters the suction of a downhole pump.

Another object of the present invention is the treatment of crude oil by the arrangement of a crystalline metal upstream or a downhole pump so that the formation fluid in the bottom of a borehole must flow in intimate contact with the crystalline metal before entering the pump intake.

A still further object of the present invention is the provision of a gas anchor made of an alloy which contacts formation fluid flowing therethrough and reduces corrosion and other deleterious effects associated with the production of hydrocarbons.

These and various other objects and advantages of the invention will become readily apparent to those skilled in the art upon reading the following detailed description and claims and by referring to the accompanying drawings.

The above objects are attained in accordance with the provision of a method for use with apparatus fabricated in a manner substantially as described herein.

DETAILED DESCRIPTION OF THE PREFERRED EMBODIMENT

Figure 1:
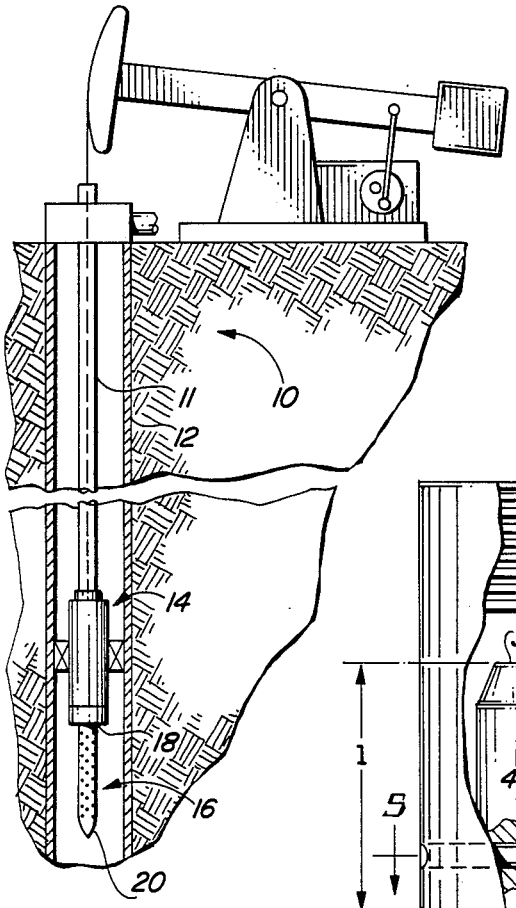
FIG. 1 is a diagrammatical, representation of an oil well production unit with apparatus made in accordance with the present invention being shown in conjunction therewith.
Figure 4:
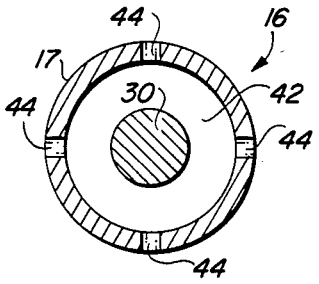
FIG. 4 is a cross-sectional view taken along line 4—4 of FIG. 2.
Figure 5:
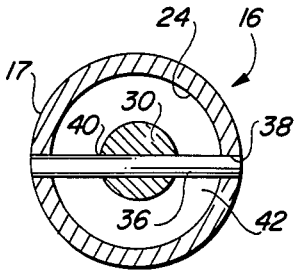
FIG. 5 is a cross-sectional view taken along line 5—5 of FIG. 2.
Figure 2:
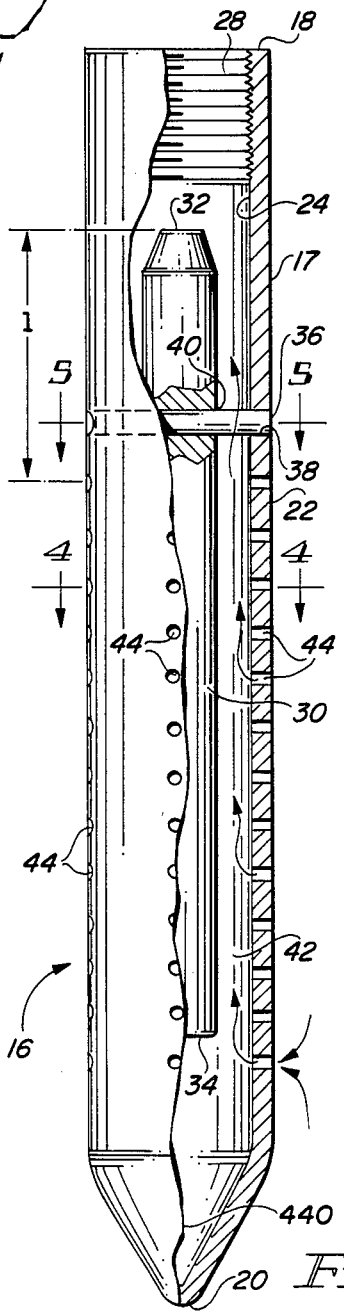
FIG. 2 is an enlarged, part longitudinal, cross-sectional view of part of the apparatus disclosed in FIG. 1.
Figure 3:
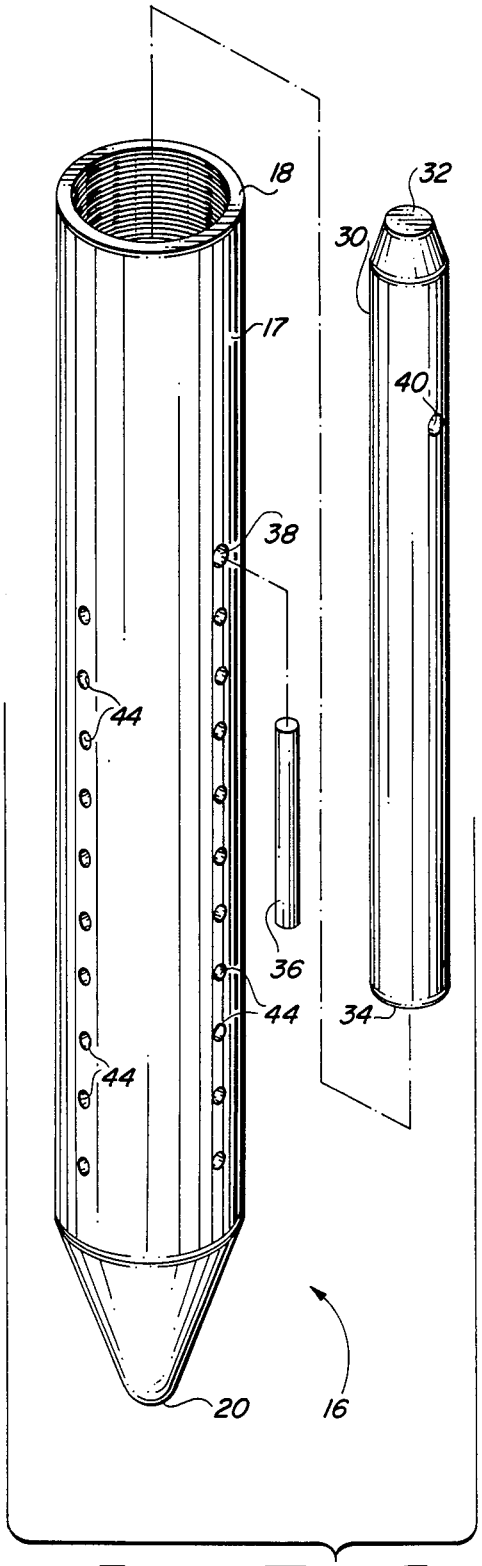
FIG. 3 is a disassembled view of the apparatus disclosed in FIG. 2.

In FIG. 1 of the drawings, there is diagrammatically illustrated an oil well production unit, which includes a pumpjack unit 10 for reciprocating a sucker rod string located within a production tubing 11. The production tubing 11 is concentrically located within wellbore 12 and connected to a downhole pump 14 in the usual manner. The downhole pump 14 has a suction end at the lower extremity thereof to which there is attached a gas anchor 16 made in accordance with the present invention.

As seen in FIGS. 2–5, the gas anchor 16 has attachment means at the upper end 18 thereof and a lower terminal end 20 which extends downhole from the pump 14. Formation fluid surrounds the lower end of the pump, causing the gas anchor to be submerged within the formation fluid and accordingly, formation fluid must flow into the gas anchor where it is available at the suction of the pump 14. The action of pump 14 forces the produced fluid to flow up the tubing string 11 and to the surface of the ground.

FIGS. 2–5 show that the gas anchor 16 has an outer shell 22 made of the crystalline metal alloy set forth herein. The outer surface of the shell is opposed to an inner wall 24. The upper marginal length of inner wall 24 is threaded at 28 so that the attached end 18 can be threadedly engaged with the suction of the pump 14. A metal alloy rod SO has an upper end 32 opposed to a lower end 34. The metal rod is supported along the axial centerline of the metal alloy housing 22 by means of pin member 36. The housing is drilled at 38 and the rod is drilled at 40 for accommodating pin 36 therethrough.

The inside diameter of the inner wall 24 and the outside diameter of the metal alloy rod 30 is arranged such that an annulus 42 is formed therebetween. In one form of the invention, the outside diameter of the outer shell 22 is $1\frac{5}{8}$ inches, the inside diameter 24 is $1\frac{1}{4}$ inches, and the outside diameter of the metal rod SO is $\frac{7}{8}$ inches. This leaves an annulus 42 which is 3/16 inches thick. The housing 22 is $16\frac{1}{2}$ inches long while the rod 30 is $8\frac{3}{4}$ inches long, and l=4 inches in FIG. 2.

Perforations 44 are 5/32 inches in diameter and are formed in the lower marginal end of the housing, with the upper marginal ends of the housing being left unperforated so that the metal allot rod 30 has a lower end extended into the perforated portion of the housing and an upper end 32 extending into the unperforated portion of the housing. Consequently, formation fluid is forced to flow through the multiplicity of perforations 44, into the annulus 42, up the annulus and through an unperforated part of the annulus where the fluid continues past the threaded portion 28 as it flows into the pump suction. This action subjects the formation fluid to treatment by intimate contact with the metal alloy rod and housing, and significantly reduces corrosion because of the inhibiting characteristics that the metal alloy exhibits respective to the wellbore fluids.

The composition of the metal alloy is as follows:

copper: 40–66%
lead: 2–12%
zinc: 2–28%
tin: 1–5%
nickel: 5–25%

The present invention does not provide the desired results when any one of the above components are deleted from the crystalline metal. The presence of a trace of iron, antimony, sulfur, and manganese appear to be an inherent part of the process used in manufacturing the alloy. These trace elements are believed not to be important but are included herein since they result from the alloying process.

Still more specifically, the above alloy further includes the trace elements: iron, antimony, sulfur, and manganese present in the following range:

iron: 0.2–0.9%
antimony: 0.5–1.5%
manganese 0.01–0.09%
sulfur: 0.02–0.12%

A specific example of the preferred alloy used in this invention is:

| | Percent by Weight |
|---|---|
| copper | 57.64 |
| zinc | 17.63 |
| nickel | 13.45 |
| lead | 7.66 |
| tin | 2.69 |
| iron | .69 |
| antimony | .12 |
| sulfur | .07 |
| manganese | .05 |

In operation, the gas anchor 16 of the present invention is threadedly mated with the suction end of the downhole pump 14 by utilizing the threads 28 formed at the attached end of the housing. The pump 14 and gas anchor 16 are run downhole and mounted into position using the usual packers and anchoring devices known to those skilled in the art. Formation fluid from the lower end of the borehole must now enter the gas anchor and flow in intimate contact with respect to the alloy composition thereof before the formation fluid enters the pump suction. This subjects the formation fluid to the desirable, beneficial treatment of the alloy composition of the gas anchor and thereby significantly reduces corrosion of the pump parts along with the production tubing string 11, sucker rod string, and the other flow lines that may be attached to the wellhead.

A chamber 440 is formed below the lower end 34 of the metal alloy rod 30 for accumulating debris that may enter the perforations 34. The metal alloy rod 30 is held centered respective to the housing 22, with the inside diameter of the inner wall respective to the outside diameter of the rod 30 being selected so that the pressure drop of the formation fluid flowing through the gas anchor is of an acceptable value to the production engineer.

The ports 44 can be arranged in any number of different patterns so long as they are of a size and number to subject the formation fluid to treatment as the fluid flows through the gas anchor. Preferably, the ports are 5/32 inch diameter arranged in rows 90° respective to one another with there being four sets of twelve ports to provide 48 ports 44 that flow connect the lower borehole to the gas anchor annulus 42. This should operate satisfactorily for wells that produce up to 60 barrels per day. The diameter of both the housing and rod can be increased, along with the number of ports 44, in order to accommodate higher production rates.

I claim:

1. A downhole pump for use in a borehole which extends through a formation from which formation fluid flows into the borehole, said pump is located in said borehole and has a suction end for receiving formation fluid and an outlet end through which produced fluid flows into a tubing string and to the surface of the ground; the improvement comprising:

a gas anchor attached to the suction end of the pump through which formation fluid must flow; said gas anchor a perforated housing and a core, said housing has attachment means at an upper end thereof by which it is removably affixed to the suction end of the pump; said housing has a closure means at the lower end thereof through which fluid flow is precluded;

said core is contained within said perforated housing, an annular passage means formed between the core and the housing through which formation fluid must flow from the housing perforations to the pump suction;

said core and said housing are made from an alloy having the following percent composition:
copper: 40–66%;
zinc: 2–28%
nickel: 5–25%;
lead: 2–12%; and
tin: 1–5%;

said core is an elongated rod having an outside diameter which is smaller than the housing inside diameter such that an annulus is formed therebetween, thereby forming said annular passage means; the lower marginal end of the housing is perforated while the upper marginal end thereof is imperforate; said core and said housing are cylindrical in cross-section configuration; said perforations are all located at the lower marginal end of the housing, and said rod has a lower marginal end located in the perforated lower marginal end of the housing and an upper marginal end of the rod is located in the upper imperforate marginal end of the housing so that all of the flow to the pump must occur through said perforations, along said annulus, and into the suction of the pump.

2. In a borehole that extends into a fluid producing formation, there being a downhole pump arranged within the borehole with the suction end thereof located in the formation fluid, the method of treating produced fluid from the borehole before the fluid enters the pump suction comprising the steps of:

connecting a housing to the pump suction in series relationship therewith so that any formation fluid that flows into the pump must first flow into the housing and then to the pump suction;

supporting an elongated rod member within said housing so that an annular passage means is formed therebetween and any formation fluid flowing through the housing is brought into intimate contact with the outer surface of the rod member and the inner surface of the housing;

selecting said housing and said rod member from an alloy consisting of a mixture of the following metals: copper zinc, nickel, lead, and tin; said mixture has the following range of composition:
copper: 40–66%;
zinc: 2–28%;
nickel: 5–25%;
lead: 2–12%; and,
tin: 1–25%;

and further including the steps of forming said rod member and said housing into a cylindrical cross-sectional configuration; forming a multiplicity of apertures into the lower marginal end of said housing;

mounting said rod member in axially aligned relationship such that it is telescopingly received within said housing thereby forming said annular passage means;

closing the lower end of said housing to thereby force all of the formation fluid to flow through said apertures; positioning a lower marginal end of said rod in the perforated lower marginal end of said housing and positioning an upper marginal end of said rod in the upper imperforate marginal end of said housing so that all of the formation fluid flows directly from the borehole, through said perforations, then only along said annulus in intimate contact with said alloy as it is forced through said annular passage means; and directly to the pump suction.

* * * * *

UNITED STATES PATENT AND TRADEMARK OFFICE

CERTIFICATE OF CORRECTION

PATENT NO. : 4,789,031

DATED : DECEMBER 6, 1988

INVENTOR(S) : CLAUD W. WALKER

It is certified that error appears in the above-identified patent and that said Letters Patent is hereby corrected as shown below:

Column 2, line 51, substitute --of-- for "or";

Column 3, line 44, substitute --30-- for "SO";

Line 54, substitute --30-- for "SO";

Line 57, substitute --ℓ-- for "I";

Line 61, substitute --alloy-- for "allot";

Column 4, line 59, substitute --44-- for "34";

Column 5, line 20, insert --consists essentially of-- after "chor".

Signed and Sealed this

Fourth Day of July, 1989

*Attest:*

*Attesting Officer*

DONALD J. QUIGG

*Commissioner of Patents and Trademarks*